US008863632B1

(12) United States Patent
O'Malley

(10) Patent No.: US 8,863,632 B1
(45) Date of Patent: Oct. 21, 2014

(54) CHARGING HANDLE

(71) Applicant: Kevin O'Malley, Jacksonville, FL (US)

(72) Inventor: Kevin O'Malley, Jacksonville, FL (US)

( * ) Notice: Subject to any disclaimer, the term of this patent is extended or adjusted under 35 U.S.C. 154(b) by 8 days.

(21) Appl. No.: 13/861,662

(22) Filed: Apr. 12, 2013

Related U.S. Application Data

(60) Provisional application No. 61/623,259, filed on Apr. 12, 2012.

(51) Int. Cl.
*F41A 3/72* (2006.01)
*F41A 7/02* (2006.01)

(52) U.S. Cl.
CPC .... *F41A 7/02* (2013.01); *F41A 3/72* (2013.01)
USPC ..... 89/1.4; 89/1.42; 42/16; 42/25

(58) Field of Classification Search
CPC ..... F41A 3/72
USPC ..... 89/1.4, 1.42; 42/16, 25
See application file for complete search history.

(56) References Cited

U.S. PATENT DOCUMENTS

| | | | | |
|---|---|---|---|---|
| 2,832,165 | A | 4/1958 | Ivy | |
| 3,090,148 | A | 5/1963 | Smith | |
| 5,179,245 | A | 1/1993 | Straka | |
| 6,019,024 | A | 2/2000 | Robinson et al. | |
| 6,851,346 | B1 * | 2/2005 | Herring | 89/1.4 |
| 7,231,861 | B1 | 6/2007 | Gauny et al. | |
| 7,900,546 | B2 | 3/2011 | Bordson | |
| 8,567,301 | B1 * | 10/2013 | Sharron | 89/1.4 |
| 2003/0066226 | A1 | 4/2003 | Martin | |
| 2009/0241396 | A1 | 10/2009 | McManus | |
| 2011/0036232 | A1 | 2/2011 | Dublin | |
| 2011/0061523 | A1 | 3/2011 | Webb | |
| 2011/0174139 | A1 | 7/2011 | Olsen et al. | |
| 2011/0226120 | A1 | 9/2011 | Fitzpatrick et al. | |

OTHER PUBLICATIONS www.RARGUNS.com: Non-Patent Literature/Article on R.A.R. Guns Sidewinder Charging Handle http://www.firearmstalk.com/forums/f53/r-r-guns-sidewinder-charging-handle-37413/.

* cited by examiner

*Primary Examiner* — Michael David
(74) *Attorney, Agent, or Firm* — Allen, Dyer, Doppelt, Milbrath & Gilchrist

(57) ABSTRACT

A charging handle assembly for an assault rifle includes a bolt engagement arm having an axially elongated shaft extending between a forward end and a rear end, a manual operator adapted to be manipulated by a user for effecting sliding movement of the bolt engagement arm, an operator extension elongated in the axial direction, connecting the manual operator with the rear end of bolt engagement arm and holding the manual operator forwardly thereof and laterally separated from the bolt engagement arm, an engagement latch mounted to the manual operator so as to be movable between an engagement position and an disengagement position, a biasing element extending between the manual operator and the engagement latch and biasing the engagement latch into the engagement position. A latch retainer can be attached to a mounting rail for receiving the engagement latch.

20 Claims, 3 Drawing Sheets

CHARGING HANDLE

CROSS-REFERENCE TO RELATED APPLICATION

This application claims the benefit of U.S. Provisional Patent Application Ser. No. 61/623,259, filed on Apr. 12, 2012, the contents of which are herein incorporated by reference in their entirety.

FIELD OF THE INVENTION

The present invention relates to charging handles for firearms, and more particularly, to charging handles for assault rifles like the M-16, AR-15, M-4 and variants thereof.

BACKGROUND OF THE INVENTION

Many firearms incorporate some manner of charging handle, sometimes also referred to as a cocking handle or bolt handle, allowing a user of the firearm to manually draw a bolt of the firearm to the rear. This can serve various purposes depending on the firearm. For instance, even in automatic and semi-automatic rifles, in which the firing mechanism automatically cycles the bolt under ordinary circumstances, it may be necessary to use the charging handle to clear the firearm after a misfire.

In assault rifles like the M-16, AR-15 and M-4, the charging handle enters the receiver via an opening on the rear end thereof above where the buffer tube for the buttstock extends rearwardly. The typical charging handle for such rifles includes a shaft that is inserted through the opening in the receiver and with a front end engaging the bolt and an operator portion at a rear end of the bolt engagement portion that is adapted to be grasped by the user and incorporates a latch.

The charging handle is slidable via the between a forward position and a rearward position. In the forward position, the shaft is completely contained or almost completely contained within the receiver, the operator portion abuts the opening on the receiver, and the latch engages the receiver adjacent the opening to lock the charging handle in the forward position. With the latch disengaged, the operator portion is drawn rearwardly over the butt stock/stock tube until most of the bolt engagement portion is exposed. While typical charging handles are effective for moving the bolt rearwardly, further improvements are possible.

For example, with reference to FIG. 1, an assault rifle 110 includes a receiver 112 and an accessory mounting rail 114. A prior art charging handle 120 is inserted in the rear of the receiver 112 and is operable to engage a bolt of the rifle 110. Referring to FIG. 2, the charging handle 120 includes an elongated shaft 122 extending between first and second ends 124, 126. The first end is configured to engage the bolt and the second end 126 is enlarged to form an operator portion adapted to be grasped by a user in order to slide the charging handle 120 into and out of the receiver. Typically, a spring-biased engagement latch is mounted on the second end 126 to engage the receiver 112 and hold the charging handle in place when fully inserted.

While typical charging handles are effective for moving the bolt rearwardly, further improvements are possible.

SUMMARY OF THE INVENTION

In view of the foregoing, it is an object of the present invention to provide an improved charging handle, and in particular an improved charging handle for assault rifles where a bolt engagement portion of the charging handle is inserted through an opening on the rear end of the receiver.

According to an embodiment of the present invention, a charging handle assembly for an assault rifle includes a bolt engagement arm having an axially elongated shaft extending between a forward end and a rear end, a manual operator adapted to be manipulated by a user for effecting sliding movement of the bolt engagement arm, an operator extension elongated in the axial direction, connecting the manual operator with the rear end of bolt engagement arm and holding the manual operator forwardly thereof and laterally separated from the bolt engagement arm, an engagement latch mounted to the manual operator so as to be movable between an engagement position and an disengagement position, a biasing element extending between the manual operator and the engagement latch and biasing the engagement latch into the engagement position. A latch retainer can be attached to a mounting rail for receiving the engagement latch.

According to an aspect of the present invention, the operator extension, the operation extension also holds the manual operator vertically below the bolt engagement portion. Advantageously, the operator extension is contoured to closely follow the receiver, so as to minimize head movement required by a user when drawing the charging handle to the rearward position.

These and other objects, aspects and advantages of the present invention will be better appreciated in view of the drawings and following detailed description of preferred embodiments.

DETAILED DESCRIPTION OF PREFERRED EMBODIMENTS

For referential purposes, directional terms are used herein relative to an assault rifle held with its firing axis horizontally, such that its trigger extends toward the ground. The term "axial" refers to the direction of the firing axis, with "forward" being axially toward the muzzle and "rear" being axially toward the buttstock. The term "lateral" refers to the horizontal direction perpendicular to the axial direction, with "right" and "left" being referenced to the forward direction. The term "vertical" refers to the vertical direction perpendicular to the axial direction, with "above" and "below" describing relative positions in the vertical direction.

Figure 1:
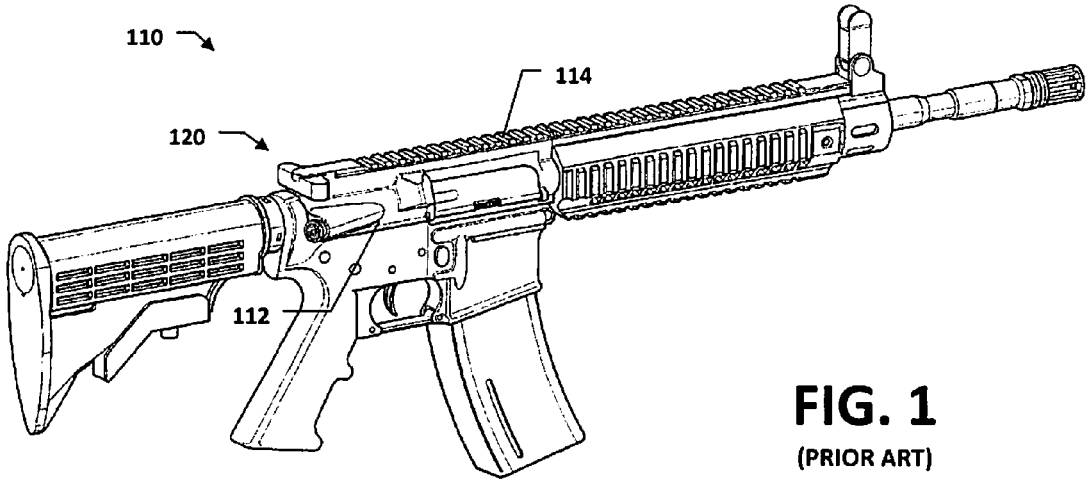
FIG. 1 (PRIOR ART)
FIG. 1 is a perspective view of an assault rifle with a prior art charging handle inserted therein.
Figure 2:
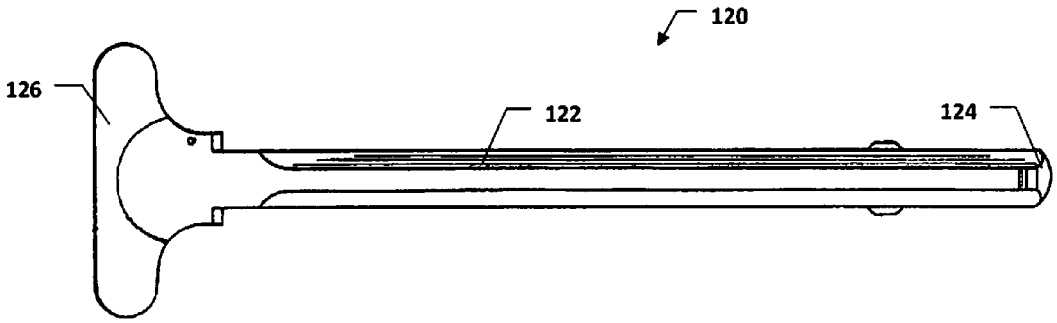
FIG. 2 (PRIOR ART)
FIG. 2 is a top view of the charging handle of FIG. 1.
Figure 3:
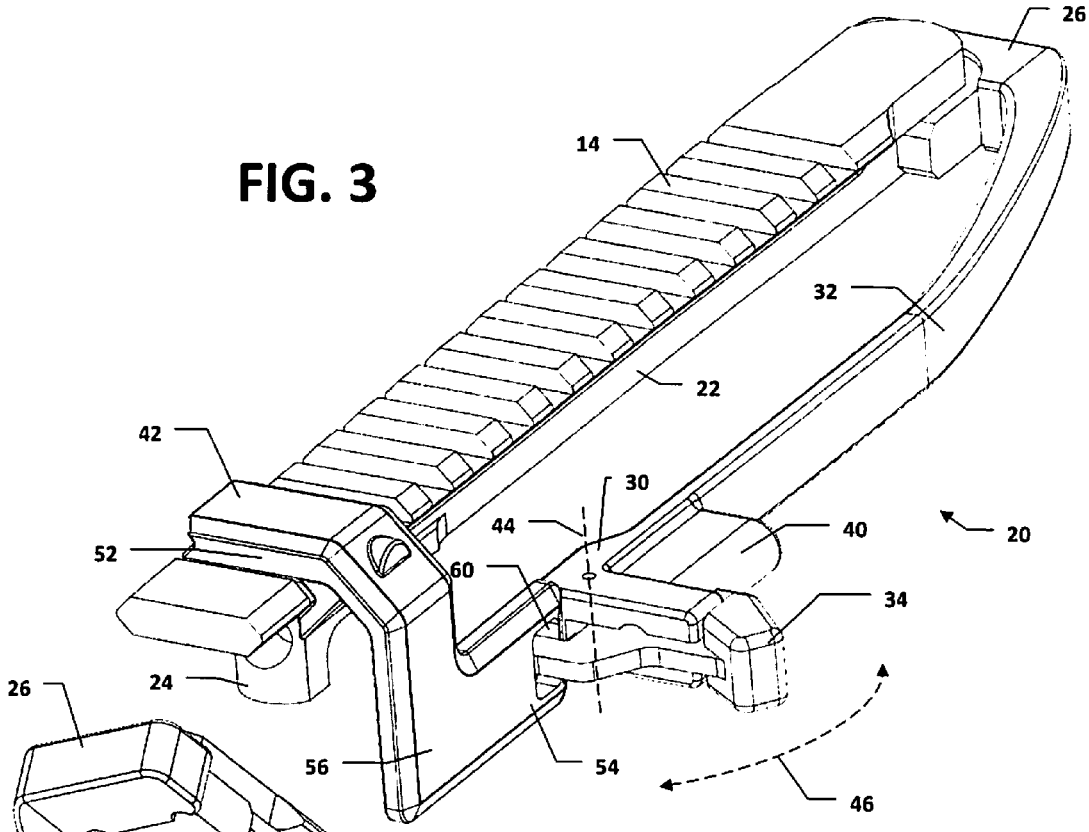
FIG. 3 is an isometric view of a charging handle assembly, according to an embodiment of the present invention.
Figure 4:
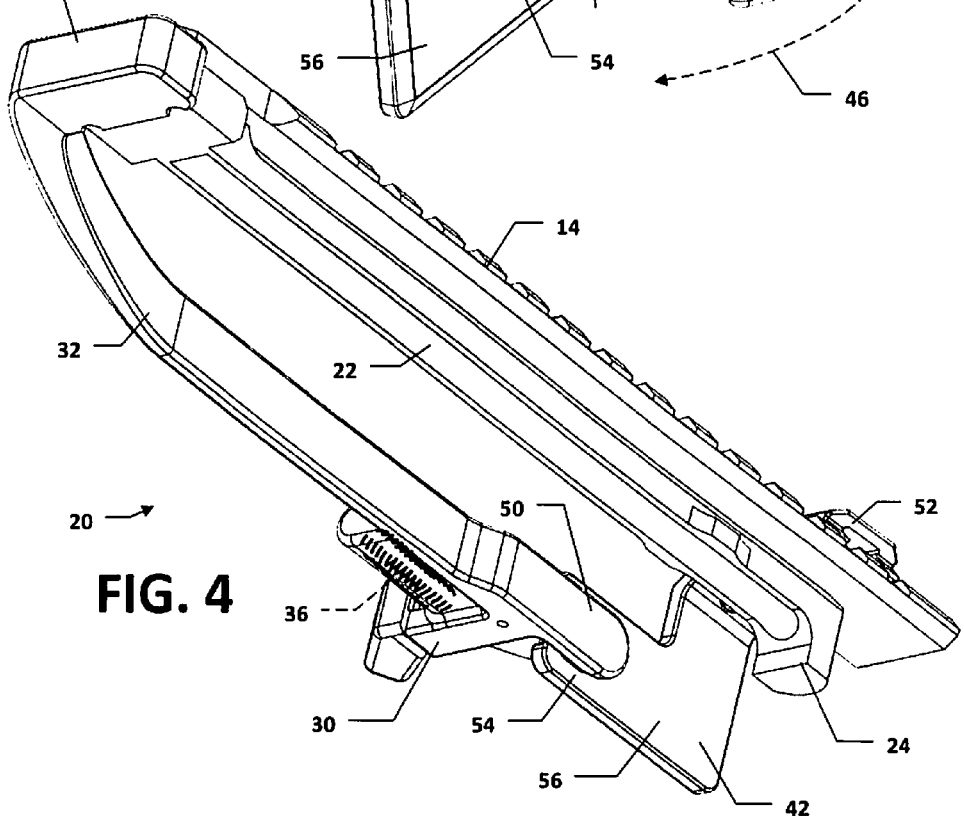
FIG. 4 is another isometric view of the charging handle of FIG. 3, with hidden components shown in broken lines.

Referring to FIGS. 1 and 2, according to an embodiment of the present invention, a charging handle assembly 20 includes a bolt engagement arm with an axially elongated shaft 22 extending between first and second ends 24, 26. For clarity of illustration, the charging handle assembly 20 is shown relative to an assault rifle accessory mounting rail 14 section. However, the shaft 22 is dimensioned to be slidably received into a charging handle opening on a rear end of a receiver of an assault rifle, just as the charging handle 120 shaft 122 is slidably inserted into the receiver 112, with the first end 24 configured to engage the bolt.

While the shaft 22 and first end 24 are essentially the same as on the conventional charging handle 120, in the charging handle assembly 20, a manual operator 30 is held forwardly of the rear end 26, and laterally and vertically separated from the shaft 22, by an axially elongated operator extension 32. Advantageously, the bolt engagement arm, the operation extension 32 and the manual operator 30 are formed as a single, continuous piece.

The manual operator 30 is adapted for manipulation by a user to effect sliding movement of the bolt engagement arm. An engagement latch 34 is connected to the manual operator 30 and movable between an engagement position and a disengagement position to releasably hold the charging handle assembly 20 in place when the shaft 22 is fully inserted. A biasing element 36, such as a spring, biases the engagement latch 34 into the engagement position. The biasing element 36 is advantageously contained in a spring housing 40 formed on the manual operator 30.

The engagement latch 34 can be configured to engage a recess or other structural element on the assault rifle, or a latch retainer 42 releasably mounted to the accessory mounting rail can advantageously be employed to receive the engagement latch 34 in the engagement position. Preferably, the engagement latch 34 is pivotably mounted to the manual operator 30 about a vertical axis 44 so as to be pivoted between the engagement and disengagement positions in direction 46. The manual operator 30 advantageously further includes an engagement latch contact plate 50. In the engagement position, the engagement latch 34 contacts the plate 50 through the latch retainer 42.

The latch retainer 42 has a rail-mounting portion 52 that is configured to be mounted on the accessory mounting rail 14 and a latch engagement portion 54 configured to engage the engagement latch 34. A connecting portion 56 displaces the latch engagement portion laterally, downwardly and rearwardly of the rail-mounting portion 52. In general, the more rearward section of the accessory mounting rail 14 is desirable for mounting other accessories, such as a scope, thus the rearward displacement of the latch engagement portion 56 frees up more of this section. Although the latch retainer 42 depicted is configured for connection to an upper mounting rail, latch retainers configured for attachment to lower or side mounting rails could also be used.

Preferably, the latch engagement portion 54 defines a latch opening 60 through which the engagement latch 34 can extend and contact the engagement latch contact plate 50. This adjacent relationship of manual operator 30, latch retainer 42 and engagement latch 34 affords a very stable releasable connection.

Figure 5:
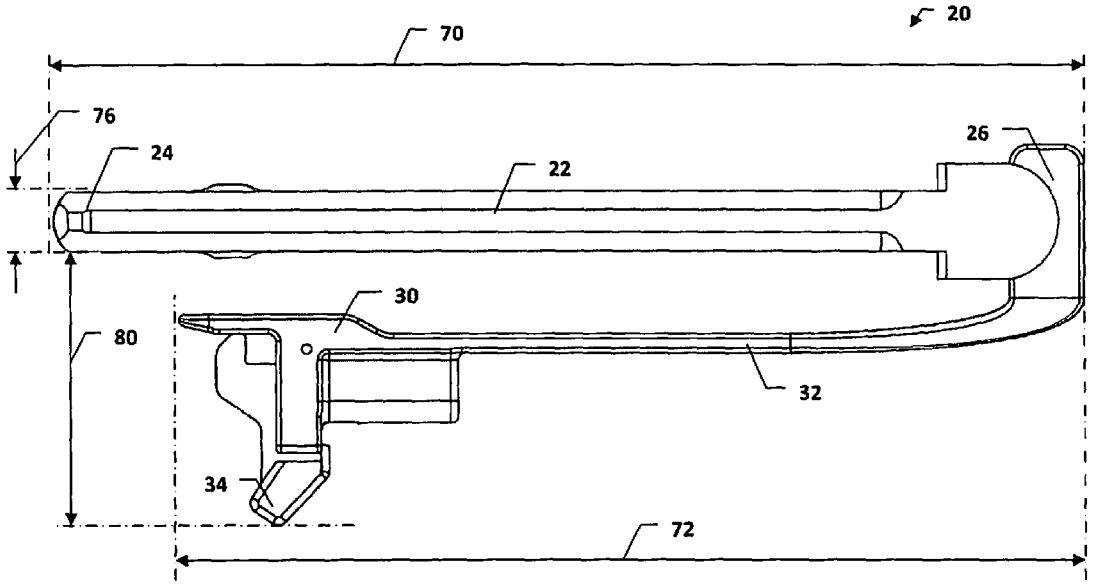
FIG. 5 is a top plane view of the charging handle of FIG. 3.
Figure 6:
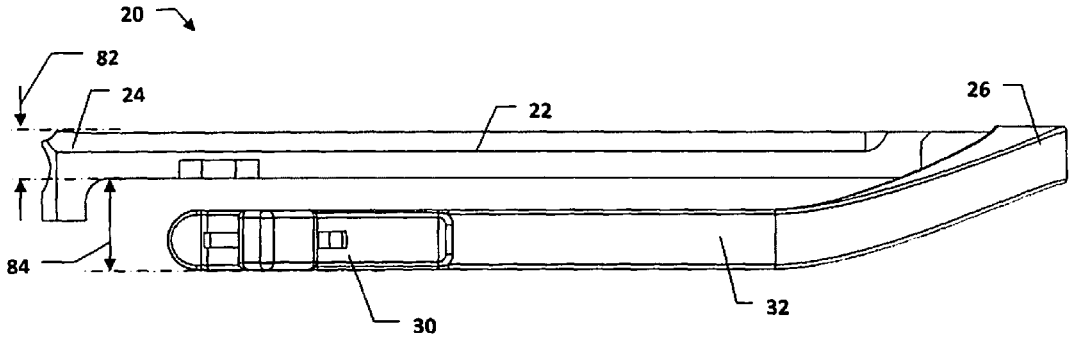
FIG. 6 is a side plane view of the charging handle of FIG. 3.

FIGS. 3-6 depict a preferred embodiment of the charging handle assembly 20 to scale. It will be appreciated that aspects of the present invention can be applied to any rear-entry assault rifle charging handle to provide a more convenient side operating position. In FIGS. 5 and 6, certain preferred relative dimensions are described and points of reference used in connection therewith are illustrated.

The bolt charging arm shaft 22 has an overall length 70. The operator extension 32 holds the manual operator 30 at a distance 72 forward of the second end 26. Preferably, that distance 72 is at least 50% of the overall shaft length 70, and more preferably, at least 75% of the overall shaft length 70.

The shaft 22 has a nominal shaft width 76. The operator extension 32 laterally separates the manual operator 30 from the shaft 22 within a distance 80. The outer limit of this distance should be understood to encompass the engagement latch 34 and any other carried by the manual operator 30. Preferably, the distance 80 is within six times the nominal shaft width 76, and more preferably, within five times the nominal shaft width 76. In general, the manual operator 30 and operator extension 32 should closely conform to the side of the receiver to minimize bulk and also user head movement required during use, and to reduce the likelihood of snagging.

The shaft 22 also has nominal shaft height 82. The operator extension 32 vertically separates the manual operator 30 (including any attachments) from the shaft 22 within a distance 84. Preferably, the distance 84 is within three times the nominal shaft height 82, and more preferably, within two times the nominal shaft height 82. Generally, the manual operator 30 should be positioned low enough to minimize interference with the top rail mounting area but high enough to allow clear access and operation.

The position of the manual operator allows a user to operate the charging handle with only minimal head movement compared to operation of a conventional, rearward exiting charging handle. There are multiple advantages to this positioning, including better maintenance of sight picture during charging handle operation and less indication to a potential enemy of a malfunctioning or empty firearm.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A charging handle assembly for an assault rifle comprising:

a bolt engagement arm having an axially elongated shaft extending between a forward end and a rear end, the shaft being dimensioned to be slidably received into a charging handle opening on a rear end of a receiver of the assault rifle with the forward end being configured to engage a bolt of the assault rifle;

a manual operator adapted to be manipulated by a user for effecting sliding movement of the bolt engagement arm;

an operator extension elongated in the axial direction, connecting the manual operator with the rear end of the bolt engagement arm and holding the manual operator forwardly thereof and laterally separated from the bolt engagement arm.

2. The charging handle assembly of claim 1, wherein the bolt engagement arm, manual operator and operator extension are a single, continuous piece.

3. The charging handle assembly of claim 1, wherein the bolt engagement arm has an overall arm length and the operator extension holds the manual operator at least 50% of the overall shaft length forwardly of the rear end of the bolt engagement arm.

4. The charging handle assembly of claim 3, wherein the bolt engagement arm holds the manual operator at least 75% of the overall shaft length forwardly of the rear end of the bolt engagement arm.

5. The charging handle assembly of claim 1, wherein the shaft has a nominal shaft width and the operator extension holds the manual operator laterally separated from the shaft within six times the nominal shaft width.

6. The charging handle assembly of claim 5, wherein the operator extension holds the manual operator laterally separated from the shaft within five times the nominal shaft width.

7. The charging handle assembly of claim 1, wherein the operator extension holds the manual operator vertically separated below the shaft.

8. The charging handle assembly of claim 7, wherein the shaft has a nominal shaft height and the operator extension holds the manual operator vertically separated within three times the nominal shaft height below the bolt engagement arm.

9. The charging handle assembly of claim 1, wherein the bolt engagement arm has an overall arm length and the shaft has a nominal shaft width, and the operator extension holds the manual operator at least 75% of the overall shaft length forwardly of the rear end of the bolt engagement arm and laterally separated from the shaft within five times the nominal shaft width.

10. The charging handle assembly of claim 1, wherein the operator extension holds the manual operator vertically separated below the bolt engagement arm, the shaft has a nominal shaft height and the operator extension holds the manual operator vertically separated within three times the nominal shaft height below the shaft.

11. The charging handle assembly of claim 1, further comprising:

an engagement latch mounted to the manual operator so as to be movable between an engagement position and an disengagement position.

12. The charging handle assembly of claim 11, further comprising:

a biasing element extending between the manual operator and the engagement latch and biasing the engagement latch into the engagement position.

13. The charging handle assembly of claim 12, where the manual operator includes a biasing element housing accommodating the biasing element and extending rearwardly of the engagement latch.

14. The charging handle assembly of claim 11, wherein the engagement latch is pivotably mounted to the manual operator about a vertical axis.

15. The charging handle assembly of claim 11, further comprising:

a latch retainer having a rail-mounting portion configured to be mounted to an accessory mounting rail of the receiver, a latch engagement portion configured to engage the engagement latch and a connecting portion laterally displacing the latch engagement portion from the mounting rail portion.

16. The charging handle assembly of claim 15, wherein the connecting portion vertically displaces the latch engagement portion from the rail-mounting portion.

17. The charging handle assembly of claim 16, wherein the latch engagement portion extends rearwardly of the connecting portion.

18. The charging handle assembly of claim 15, wherein the latch engagement portion includes a latch opening through which the engagement latch extends.

19. The charging handle assembly of claim 18, wherein the manual operator includes an axially extending engagement latch contact plate arranged such that the engagement latch contacts the contact plate through the latch opening.

20. A charging handle assembly for an assault rifle comprising:

a bolt engagement arm having an axially elongated shaft extending between a forward end and a rear end, the shaft being dimensioned to be slidably received into a charging handle opening on a rear end of a receiver of the assault rifle with the forward end being configured to engage a bolt of the assault rifle;

a manual operator adapted to be manipulated by a user for effecting sliding movement of the bolt engagement arm;

an operator extension elongated in the axial direction, connecting the manual operator with the rear end of the bolt engagement arm and holding the manual operator forwardly thereof and laterally separated from the bolt engagement arm;

an engagement latch mounted to the manual operator so as to be movable between an engagement position and a disengagement position;

a biasing element extending between the manual operator and the engagement latch and biasing the engagement latch into the engagement position; and a latch retainer having a rail-mounting portion configured to be mounted to an accessory mounting rail of the receiver, a latch engagement portion configured to engage the engagement latch and a connecting portion laterally displacing the latch engagement portion from the mounting rail portion.

* * * * *